US006790054B1

(12) United States Patent
Boonsue

(10) Patent No.: US 6,790,054 B1
(45) Date of Patent: Sep. 14, 2004

(54) TWO-PIECE RIGHT ANGLE CONTACT EDGE CARD CONNECTOR

(75) Inventor: Nop Boonsue, Escondido, CA (US)

(73) Assignee: Sullins Electronic Corporation, San Marcos, CA (US)

( * ) Notice: Subject to any disclaimer, the term of this patent is extended or adjusted under 35 U.S.C. 154(b) by 0 days.

(21) Appl. No.: 10/392,048

(22) Filed: Mar. 18, 2003

(51) Int. Cl.[7] ..... H01R 12/00
(52) U.S. Cl. ..... 439/79
(58) Field of Search ..... 439/79, 701, 636, 439/637, 942

(56) References Cited

U.S. PATENT DOCUMENTS

| | | | | | |
|---|---|---|---|---|---|
| 4,403,819 | A | | 9/1983 | Weber | |
| 4,548,452 | A | | 10/1985 | Gillett | |
| 4,684,194 | A | | 8/1987 | Jenkins | |
| 4,720,156 | A | | 1/1988 | Beers | |
| 4,806,103 | A | | 2/1989 | Kniese et al. | |
| 4,955,819 | A | * | 9/1990 | Harting et al. | 439/79 |
| 5,725,389 | A | | 3/1998 | Scheer | |
| 5,785,537 | A | * | 7/1998 | Donahue et al. | 439/79 |
| 5,810,623 | A | | 9/1998 | Regnier et al. | |
| 5,848,920 | A | | 12/1998 | Klein et al. | |
| 6,077,092 | A | * | 6/2000 | Chiu et al. | 439/79 |
| 6,095,821 | A | | 8/2000 | Panella et al. | |
| 6,238,226 | B1 | | 5/2001 | Schempp et al. | |
| 6,254,435 | B1 | | 7/2001 | Cheong et al. | |
| 6,357,603 | B1 | | 3/2002 | Dingman | |
| 6,394,823 | B1 | | 5/2002 | Dunham | |
| 6,425,766 | B1 | | 7/2002 | Panella | |
| 6,638,104 | B2 | * | 10/2003 | Hashimoto et al. | 439/567 |

* cited by examiner

*Primary Examiner*—Tho D. Ta

(74) *Attorney, Agent, or Firm*—Higgs, Fletcher & Mack LLP; Charles F. Reidelbach, Jr.

(57) ABSTRACT

An edge card electrical connector is used for receiving the edge of a printed circuit board having contact pads on one or both sides adjacent to the so described edge. This two-piece right angle edge card connector includes an elongated dielectric housing having a receiving face with an elongated slot running the length of the connector creating a card insertion cavity. A plurality of PCI connector pins (peripheral component interconnect), on one or both sides of the card insertion cavity make contact with the pads located on the printed circuit board when it is inserted into the cavity. The PCI connector pins may also be stepped within the card insertion cavity with the primary engagement connectors forward of the secondary engagement connectors allowing for a staggered positioning and increased separation. This edge card electrical connector is uniquely constructed of two high density dielectric parts, a first segment and a second segment mated together with the PCI connector pins bent at a right angle to the elongated slot running the length of the connector and holding the two parts together. Each PCI connector pin is housed within a separate trough with sidewalls and alternating depths of the troughs to insure a proper separation and eliminate any possibility of contact or interference. A crimped nib on either side of the PCI connector pin restrains the connectors in place when they are inserted into the square PCI connector pin orifice. This new assembly process, along with the unique design of the two-piece right angle contact edge card connector allow the device to be used in a wider variety of applications than previous models of edge card connectors along with the ability of holding varying thickness of the edge cards and used with currents up to and exceeding three amperes. This right angle contact edge card connector has been designed for use in applications where computer peripherals, and add-on cards need to be mounted parallel to the mother-boards due to limited space.

10 Claims, 3 Drawing Sheets

TWO-PIECE RIGHT ANGLE CONTACT EDGE CARD CONNECTOR

FIELD OF THE INVENTION

This invention relates to the field of electrical connectors, more specifically defined as edge card connectors used in but not limited to the computer industry. Edge card connectors are also used in the test and evaluation of electronic peripheral components in the electronic industry.

This invention provides a unique two-piece right angle heavy-duty connection means to a PCI (peripheral component interconnect) edge card, adaptable to a variety of edge cards of varying thickness and number of contacts. Moreover this device has been designed for conventional reflow soldering to optimize manufacturing efficiencies.

More specifically this two piece right angle contact edge card connector is composed of a high density dielectric material capable of withstanding high temperatures for use in extreme environments or to be used in environmental testing of peripheral components with currents up to three amperes.

BACKGROUND OF THE INVENTION

This invention describes a new and unique two-piece right angle contact edge card connector engineered to facilitate horizontal PCI (peripheral component interconnect) card mating in space-critical applications. Edge card connectors are a type of electrical connector widely used in the electronic industry. An edge card connector receives a printed circuit board (PCB) having a mating edge and a plurality of contact pads adjacent to the edge. Such edge connectors have an elongated housing defining an elongated receptacle or slot for receiving the mating edge of the printed circuit board or card. A plurality of terminals or PCI connector pins are spaced along one or both sides of the slot for engaging the contact pads adjacent the mating edge of the board. The terminals or PCI connector pins are generally in pairs for engaging the contact pads on opposite sides of the printed circuit board. The mating edge board or card is commonly called the "daughter" board, and the board to which the connector is mounted is commonly called the "mother" board. Often there is limited room above the PCB to mount the conventional edge card connector to the motherboard making a right angle mounting of the edge card connector desirable for use with peripherals and add-on cards. Additionally, conventional edge card connectors are limited to the thickness of the card they will accommodate, whereas the disclosed invention will accommodate edge cards ranging in thickness from 0.054 inches to 0.070 inches.

More particularly this device discloses a unique assembly procedure where the PCI connectors comprised of a plurality of primary engagement and secondary engagement connectors and a two-part housing comprised of a first segment and a second segment. The primary engagement connectors are inserted into the PCI connector cavity on the front of the first segment and held in place by the crimped locking nibs seating within the square connector orifices, with the secondary engagement connectors inserted from the back or opposite side of the first segment. The second segment is then mated with the first segment with the square shank portion by inserting the PCI connector pin shank end portions through square orifices in the second segment. For assembly a plurality of rectangular orifices in the second segment mate with matching rectangular tabs of the first segment when the first and second segments are joined together. The PCI connector pins protruding past the assembled unit each within a separate confined trough are then formed over individual radius points in the confined trough like housings forming right angle parallel rows of connector ends. With this process the first segment of the right angle connector and the second segment of the right angle connector are held firmly in place with no additional adhesive or attachment means.

SUMMARY OF THE INVENTION

The present invention accomplishes its desired objects by providing a two-piece right angle contact edge card connector constructed of a high density dielectric material designed to withstand high temperatures and accommodate a variety of thickness of edge cards. The right angle contact edge card connector is comprised of a first segment and a second segment made from the high density dielectric material.

The first segment has a mounting tab on each end, both with a horizontal mounting orifice and vertical mounting orifice. There are two sets of opposing PCI connector pins located approximately between 0.010 and 0.042 inches apart. These are the primary engagement PCI connector pins and the secondary engagement PCI connector pins. The conventional card insertion cavity runs laterally the length of the right angle contact edge card connector where the contact points of the primary engagement PCI connector pins make contact with the contact pads on the inserted conventional edge card.

Each of the separate primary engagement PCI connector pins is housed in the primary PCI connector pin cavities, allowing for flexibility of movement with sidewalls providing isolation from adjacent components. A protrusion on a surface of the PCI connector cavity maintains a single point contact with the adjoining primary engagement PCI connector pins for increasing their flexibility. The square shank portion of the primary engagement PCI connector pin extends through a square orifice in the first segment of the right angle contact edge card into an isolated trough in the second segment of the right angle contact edge card. At the distal end of the right angle contact edge card connector the square shank portion of the primary engagement PCI connector pin is bent around a radius point to form the required right angle bend.

The secondary engagement PCI connector pins are deeper in the card insertion cavity and make contact where the contact points of the secondary engagement PCI connector pins make contact with the contact pads on the inserted edge card. Each of the separate secondary engagement PCI connector pins is housed in a secondary PCI connector pin cavity allowing for flexibility of movement with sidewalls providing isolation from adjacent components. The square shank portion of the secondary engagement PCI connector pin extends through an isolated trough in the second segment of the right angle contact edge card. The secondary engagement PCI connector pin is bent around a radius point to form the required right angle bend. After all the primary engagement PCI connector pins and the secondary engagement PCI connector pins have been bent into position, they are trimmed to length in a conventional shearing manner.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent construction insofar as they do not depart from the spirit and scope of the present invention.

The object of this invention is to create a heavy-duty two-piece right angle contact edge card connector.

Another object of this invention is to create a two-piece right angle contact edge card connector made from a dielectric material capable of withstanding high temperatures.

Another object of this invention is create a unique method to simplify the manufacturing process of edge card connectors.

Yet another object of this invention is to create a right angle contact edge card connector with two opposing rows of PCI connectors, a primary engagement row and a secondary engagement row.

A further object of this invention is to create a two-piece right angle contact edge card connector capable of accommodating edge cards of varying thickness.

A final object of this invention is to advance the development in the field of edge card connectors in the electrical industry.

These together with other objects and advantages which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

Figure 1:
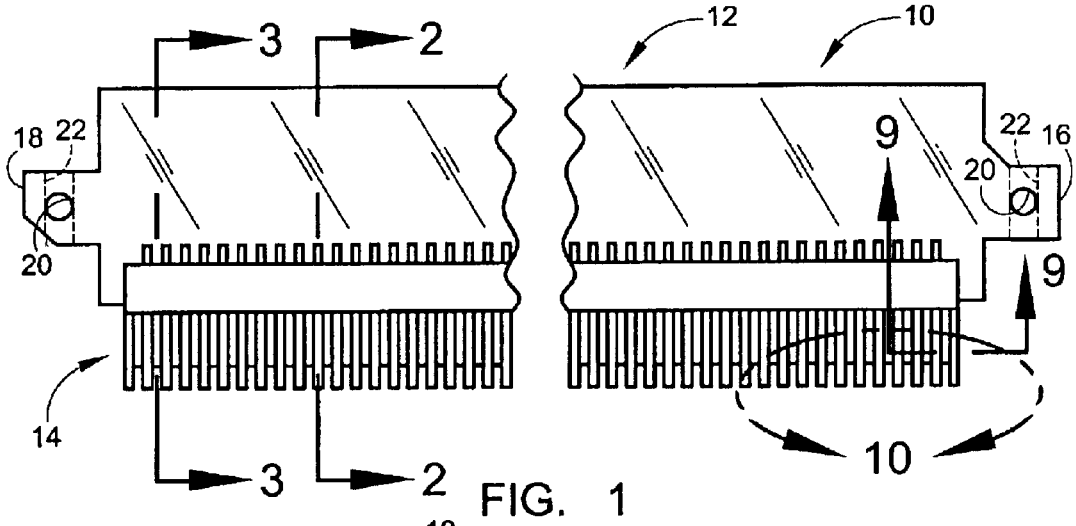
FIG. 1 depicts a top plan view of the two-piece right angle contact edge card connector.

Referring now to the drawings, wherein similar parts of the invention are identified by like reference numerals, there is seen in FIG. 1 a top plan view of the two-piece right angle contact edge card connector 10 comprised of a first segment 12 and a second segment 14 made from a dielectric material. The first segment 12 has a mounting tab 16 on the right side and a mounting tab 18 on the left side both with horizontal mounting orifice 20 and vertical mounting orifice 22.

Figure 2:
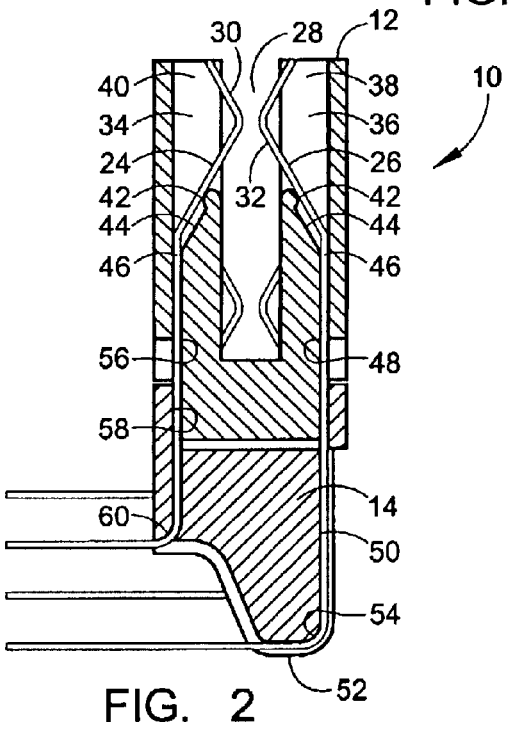
FIG. 2 depicts a section through the two-piece right angle contact edge card connector at the location of the primary engagement connector pins.

FIG. 2 depicts a section through the two-piece right angle contact edge card connector 10 at the location of the primary engagement PCI connector pins 24 and 26. The conventional card insertion cavity 28 runs laterally the length of the right angle contact edge card connector 10 where the contact points 30 and 32 of the primary engagement PCI connector pins 24 and 26 make contact with the contact pads on the inserted conventional edge card. Each of the separate primary engagement PCI connector pins 24 and 26 are housed in the primary PCI connector pin cavities 34 and 36 allowing for flexibility of movement with side walls 38 and 40 providing isolation from adjacent components. A protrusion 42 along surface 44 of the PCI connector cavities 38 and 40 maintains a single point contact with the adjoining primary engagement PCI connector pins 24 and 26 for increasing their flexibility.

The square shank portion 46 of the primary engagement PCI connector pin 26 extends through a square orifice 48 in the first segment 12 of the right angle contact edge card connector 10 into an isolated trough 50 in the second segment 14 of the right angle contact edge card 10. At the distal end 52 of the right angle contact edge card connector 10 the square shank portion 46 of the primary engagement PCI connector pin 26 is bent around a radius point 54 to form the required right angle bend. The square shank portion 46 of the primary engagement PCI connector pin 24 extends through a square orifice 56 in the first segment 12 of the right angle contact edge card connector 10 into square orifice 58 in the second segment 14 of the right angle contact edge card connector 10. The square shank portion 46 of the primary engagement PCI connector pin 24 is bent around a radius point 60 to form the required right angle bend.

Figure 3:
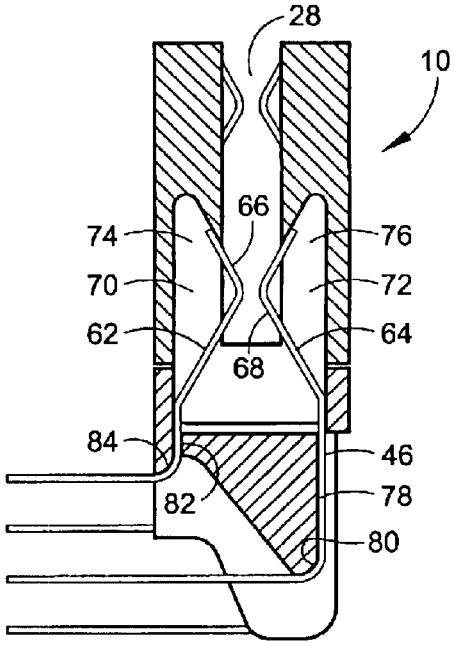
FIG. 3 depicts a section through the two-piece right angle contact edge card connector at the location of the secondary engagement connector pins.

FIG. 3 depicts a section through the two-piece right angle contact edge card connector 10 at the location of the secondary engagement PCI connector pins 62 and 64. The card insertion cavity 28 runs laterally the length of the right angle contact edge card connector 10 where the contact points 66 and 68 of the secondary engagement PCI connector pins 62 and 64 make contact with the contact pads on the inserted edge card. Each of the separate secondary engagement PCI connector pins 62 and 64 are housed in a secondary PCI connector pin cavity 70 and 72 allowing for flexibility of movement with side walls 74 and 76 providing isolation from adjacent components. The square shank portion 46 of the secondary engagement PCI connector pin 64 extends through an isolated trough 78 in the second segment 14 of the right angle contact edge card connector 10. The secondary engagement PCI connector pin 64 is bent around a radius point 80 to form the required right angle bend. The square shank portion 46 of the secondary engagement PCI connector pin 62 extends through a square orifice 82 in the second segment 14 of the right angle contact edge card connector 10. The square shank portion 46 of the secondary engagement PCI connector pin 62 is bent around a radius point 84 to form the required right angle bend. After all the primary engagement PCI connector pins 24 and 26 and the secondary engagement PCI connector pins 62 and 64 have been bent into position they are trimmed to length in a conventional shearing manner.

Figure 4:
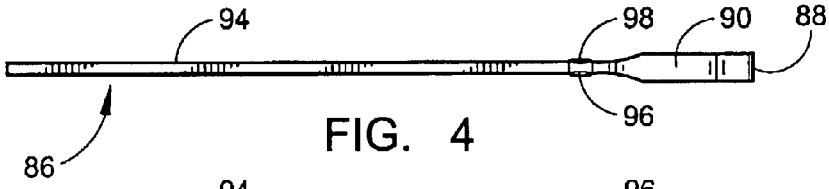
FIG. 4 depicts a top plan view of a universal PCI connector pin.
Figure 5:
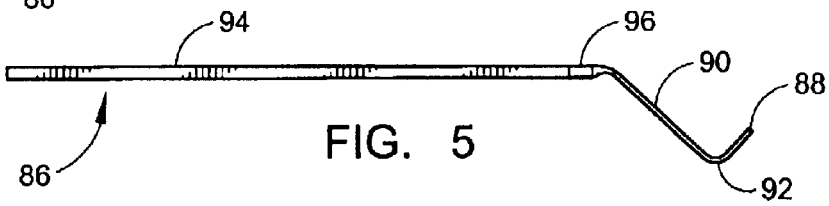
FIG. 5 depicts a side elevation of a universal PCI connector pin.

FIGS. 4 and 5 depict a universal PCI connector pin 86 with the distal end 88 flattened to form the spring contact end 90 at an angle X with the shank portion 94 and angle Y forming the contact point 92. The preferred angle X will be 155 degrees and the preferred angle Y will be 125 degrees, but it must be understood that these angles can vary as much as 25 degrees and still remain within the scope of this patent. The clearance between opposing contact points 92 will be between 0.010 and 0.042. Adjacent to the spring contact end 90 of the universal PCI connector pin 86, the square shank portion 94 has a wedged area 96 and 98 deforming the sides of the square shank portion 94 so as to create an interference fit within the square orifices 48, 56, 58 and 82 in the first segment 12 and the second segment 14 of the angle contact edge card connector 10 upon assembly.

Figure 6:
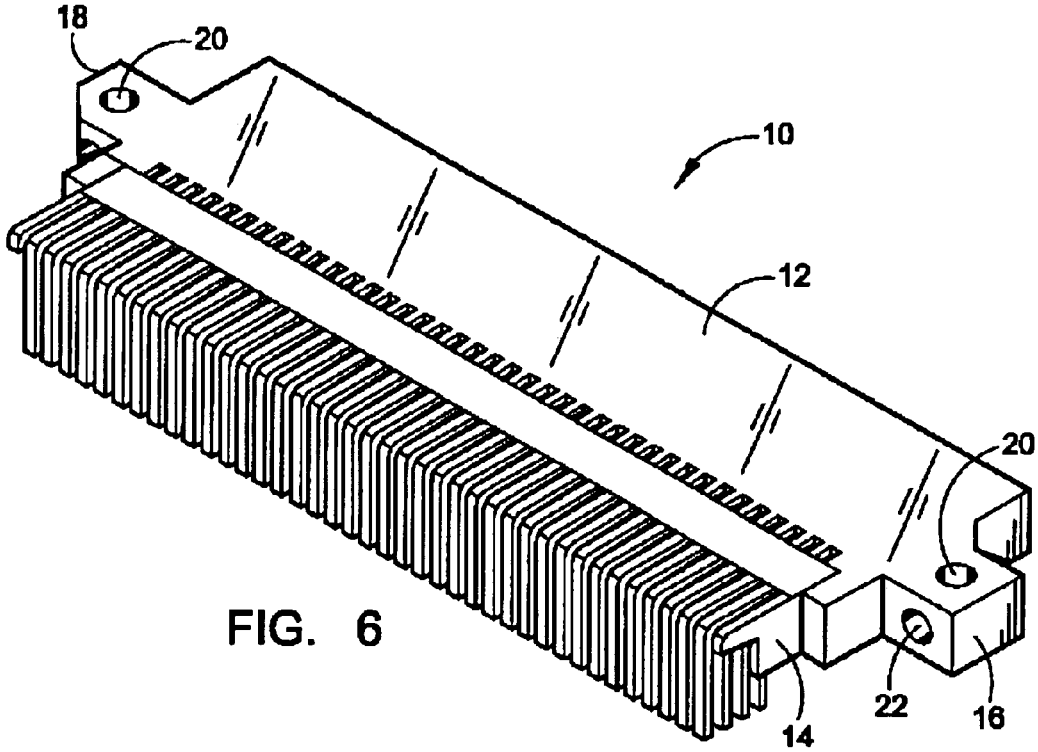
FIG. 6 depicts a perspective view of the assembled two-piece right angle contact edge card connector.
Figure 7:
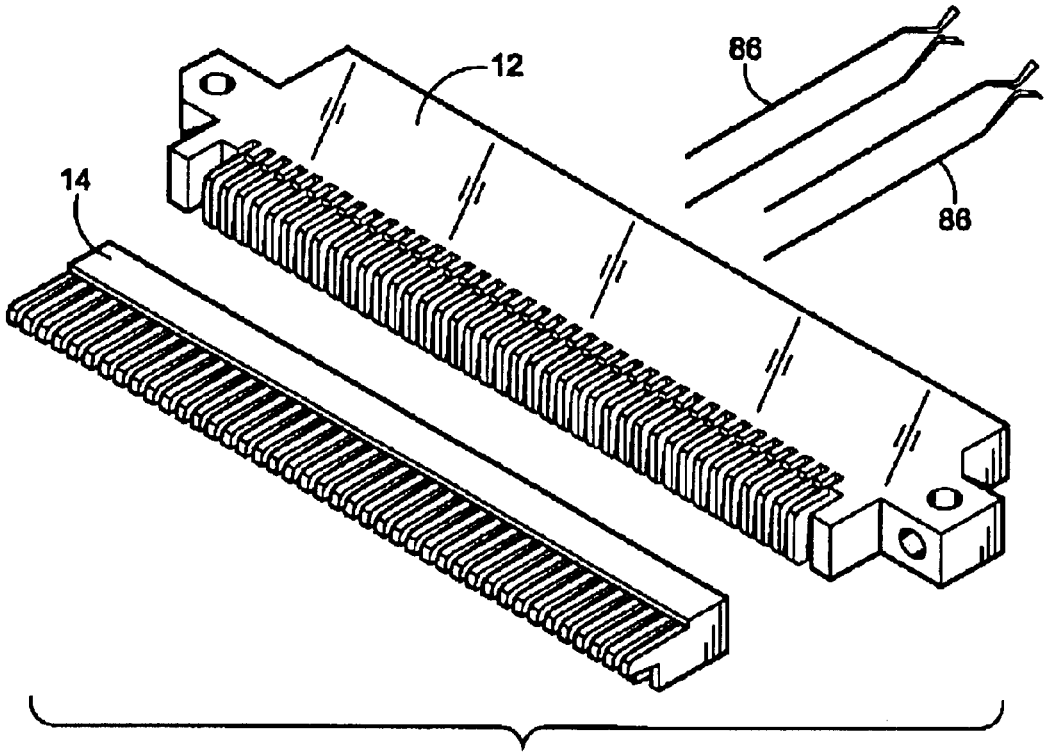
FIG. 7 depicts an exploded perspective view of a two-piece right angle contact edge card connector prior to assembly.
Figure 8:
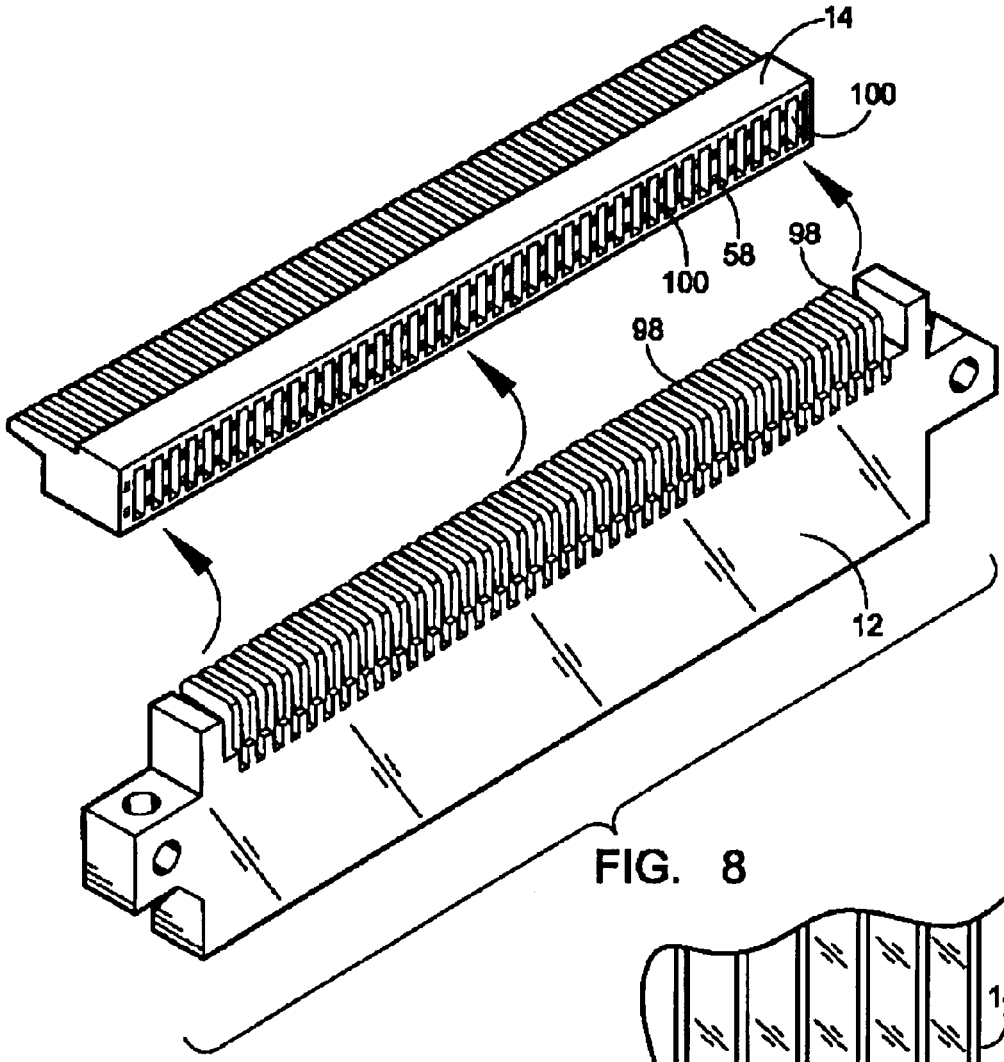
FIG. 8 depicts a perspective view of the first segment and second segment of the right angle contact edge card connector illustrating the rectangular tabs and mating rectangular slots along with the square connector pin orifice.
Figure 9:
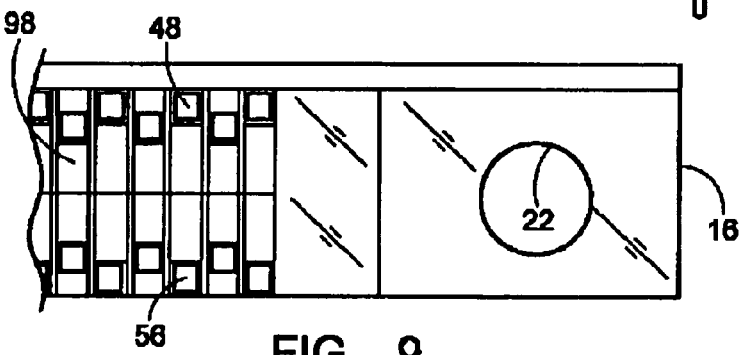
FIG. 9 depicts a view of the back of the first segment illustrating the square connector pin orifices, rectangular tabs and the vertical mounting orifice.

FIG. 6 depicts a perspective view of the assembled two-piece right angle contact edge card connector 10 indicating the locations of the horizontal mounting orifices 20 and the vertical mounting orifices 22. FIG. 7 depicts an exploded perspective view of a two-piece right angle contact edge card connector 10 prior to assembly illustrating the location of the first segment 12 and the second segment 14 and the universal PCI connector pins 86. FIG. 8 depicts a perspective view of the first segment 12 and second segment 14 of the right angle contact edge card connector 10 illustrating the rectangular tabs 98 and mating rectangular slots 100 along with the square connector pin orifices 82. FIG. 9 depicts a view of the back of the first segment 12 illustrating the square connector pin orifices 48 and 56, the rectangular tabs 98 and the vertical mounting orifice 22.

Figure 10:
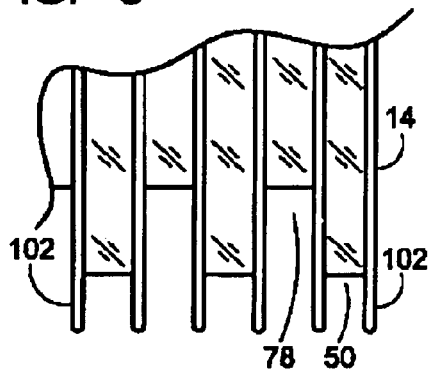
FIG. 10 depicts a segment of the troughs isolating each PCI connector pin position. Connector pins are not shown in this illustration.

FIG. 10 depicts a portion of the second segment 14 illustrating the troughs 50 and 78 and their staggered location increasing the separation of the primary engagement PCI connector pins 24 and 26 and the secondary engagement PCI connector pins 62 and 64 and the divider walls 102 isolating universal PCI connector pins 86.

The two-piece right angle contact edge card connector 10 shown in the drawings and described in detail herein disclose arrangements of elements of particular construction and configuration for illustrating preferred embodiments of structure and method of operation of the present invention. It is to be understood, however, that elements of different construction and configuration and other arrangements thereof, other than those illustrated and described may be employed for providing a two-piece right angle contact edge card connector 10 in accordance with the spirit of this invention, and such changes, alternations and modifications as would occur to those skilled in the art are considered to be within the scope of this invention as broadly defined in the appended claims.

I claim:

1. A right angle edge card connector, comprising:

a set of connector pins, each having a card contact portion and a shank portion;

a first housing for containing said card contact portions of said set of connector pins in a predetermined arrangement within a card insertion cavity formed in said housing; and a second housing, mateable with said first housing, formed to insulate and provide spatial separation between said shank portions of said set of connector pins, wherein said second housing provides a fixture having a radius point for bending said shank portions of said connector pins when said first housing is mated with said second housing.

2. A right angle edge card connector as recited in claim 1, wherein said first housing has a series of tabs and said second housing has a series of matching rectangular slots for mateable engagement with said tabs.

3. A right angle edge card connector as recited in claim 1, wherein said set of connector pins comprise a set of primary engagement connector pins and a set of secondary engagement connector pins.

4. A right angle edge card connector as recited in claim 1, wherein said first housing and said second housing are formed from a dielectric material.

5. A right angle edge card connector as recited in claim 1, wherein said second housing has a trough like section formed therein having a sequential pattern of ridges and rows.

6. A right angle edge card connector as recited in claim 5, wherein said shank portions extending past said assembled connector are formed over individual radius points in said trough like section.

7. A right angle contact edge card connector, comprising:

a housing having first and second mateable segments;

a plurality of primary engagement and secondary engagement connector pins spaced along both sides of the card insertion cavity of said first segment, each having a card contact portion and a shank portion, said shank portions of said connector pins insertable through orifices in said second segment; and a trough like housing formed in said second segment for providing a fixture having a radius point for bending portions of said connector pins protruding past said assembled first and second segments.

8. A connector as recited in claim 7, wherein said second segment has a plurality of rectangular orifices and said first segment has a plurality of matching rectangular tabs for engagement with said orifices.

9. A method of assembling a right angle contact edge card, comprising the steps of:

providing a housing having first and second segments, said second segment having a trough like housing;

inserting primary engagement connector pins into a first side of said first segment;

inserting secondary engagement connector pins into a second side of said first segment;

mating said second segment with said first segment by inserting the connector pin shank end portions through orifices in said second segment;

joining said first segment with said second segment by mating a plurality of orifices in the second segment with matching tabs of the first segment; and bending said connector pins protruding past said mated first and second segments over individual radius points in the trough like housing of said second segment, forming right angle parallel rows of connector ends.

10. A method of assembling a right angle contact edge card, comprising the steps of:

providing a housing having first and second segments;

inserting primary engagement connector pins into a first side of said first segment;

inserting secondary engagement connector pins into a second side of said first segment;

joining said first segment with said second segment by mating at least one orifice in one segment with a corresponding tab of another segment; and bending said connector pins protruding past said mated first and second segments over individual radius points in said second segment.

* * * * *